US005422797A

United States Patent [19]

Shattan

[11] Patent Number: 5,422,797

[45] Date of Patent: Jun. 6, 1995

[54] ILLUMINATED ARTIFICIAL TREE AND ITS METHOD OF MANUFACTURE

[76] Inventor: Marcia J. Shattan, 200 E. 27th St., Apt. 18B, New York, N.Y. 10016

[21] Appl. No.: 187,342

[22] Filed: Jan. 25, 1994

Related U.S. Application Data

[62] Division of Ser. No. 906,828, Jun. 30, 1992, Pat. No. 5,306,366.

[51] Int. Cl.[6] ..... F21P 1/02

[52] U.S. Cl. ..... 362/123; 362/32; 362/806; 428/18

[58] Field of Search ..... 362/32, 122, 123, 806; 156/61; 428/18, 19

[56] References Cited

U.S. PATENT DOCUMENTS

| | | | |
|---|---|---|---|
| 2,893,149 | 7/1954 | Reece et al. | 428/18 X |
| 3,056,891 | 8/1962 | Thomsen et al. | 428/18 X |
| 3,090,147 | 5/1963 | Crane | 428/18 X |
| 3,118,617 | 1/1964 | Hellrich | 362/123 |
| 3,140,970 | 7/1964 | Reukauf | 428/18 X |
| 3,215,047 | 11/1965 | Braun | 428/18 X |
| 3,477,897 | 11/1969 | Hankus | 428/18 |
| 3,564,233 | 2/1971 | Cox et al. | 362/32 |
| 3,607,586 | 9/1971 | Hankus | 428/18 |
| 3,766,374 | 10/1973 | Fairchild | 362/32 |
| 3,766,376 | 10/1973 | Sadacca et al. | 362/123 |
| 4,060,722 | 11/1977 | Foley | 362/32 |
| 4,068,118 | 1/1978 | Carrington | 362/32 X |
| 4,609,576 | 9/1986 | Liu | 428/18 |
| 4,858,086 | 8/1989 | Pietrantonio et al. | 362/32 X |
| 5,104,608 | 4/1992 | Pickering | 362/32 |

*Primary Examiner*—Ira S. Lazarus
*Assistant Examiner*—Alan B. Cariaso
*Attorney, Agent, or Firm*—Ladas & Parry

[57] ABSTRACT

An illuminated artificial tree and its method of manufacture in which a plurality of branches extend from a trunk of the tree, each branch being formed by spirally winding a strip assembly of a plurality of juxtaposed fiber optic elements and simulated pine needles on an elongated support wire. The fiber optic elements and simulated pine needles extend around the wire in adjacent relation to provide an interspersed array of pine needles and fiber optic elements all along the length of the branch. The fiber optic elements are illuminated at the base of the tree to provide points of light substantially all around each branch along its entire length. A member of branches are assembled along the trunk from the top down.

10 Claims, 6 Drawing Sheets

ILLUMINATED ARTIFICIAL TREE AND ITS METHOD OF MANUFACTURE

This is a divisional of application(s), Ser. No. 07/906,828, filed on Jun. 30, 1992, now U.S. Pat. NO. 5,306,366.

FIELD OF THE INVENTION

The invention relates to an illuminated artificial tree and its method of manufacture.

More particularly, the invention relates to an artificial tree such as a Christmas tree in which fiber optic elements are dispersed substantially uniformly throughout the foliage of the tree to produce points of light substantially all around the branches of the tree along the entire length of each branch.

BACKGROUND AND DESCRIPTION OF PRIOR ART

The art is replete with many forms of illumination of artificial Christmas trees. Some of these trees, as for example disclosed in U.S. Pat. Nos. 2,227,861, 3,465,139, 3,735,117, 3,035,162 and 2,519,690, disclose systems whereby individual illumination effects are provided at particular locations generally at the ends of branches or throughout the trunk of the tree. Some of these patents show a single illumination source while others contemplate separate illumination of respective bulbs.

Also known in the art are artificial Christmas trees which are illuminated by fiber optic elements. These include U.S. Pat. Nos. 3,564,233, 3,766,376, 4,068,118 and 4,364,102 and UK Application 2,183,813. All of these patents disclose various illumination systems which produce either point sources of light or clusters of light and require substantial complexity in their construction and assembly.

SUMMARY OF THE INVENTION

An object of the invention is to provide illumination of an artificial Christmas tree in which points of light are distributed substantially entirely along the length and around each branch of the tree.

A further object of the invention is to provide a method to achieve the above illumination which is relatively simple.

Yet another object of the invention is to provide an illuminated Christmas tree in which the points of light are integrated with the foliage of the branches and interspersed therewith.

Still another object of the invention is to provide an illuminated Christmas tree in which the points of light distributed throughout the tree are illuminated from a common source.

A further object of the invention is to provide a method for producing an illuminated Christmas tree in which the branches of the tree can all be produced by the same process which simplifies the construction and assembly of the tree.

In order to satisfy the above and further objects, the invention is directed to an illuminated artificial tree comprising a trunk and a plurality of branches extending from the trunk, each branch including an elongated support wire and a strip assembly spirally wound around said wire lengthwise thereof, the strip assembly comprising a band to which are secured along its length a plurality of juxtaposed fiber optic elements and simulated pine needles, said fiber optic elements having first ends extending from the band in adjacent relation with the simulated pine needles and second free ends extending from said band in a direction opposite the first ends and the simulated pine needles, said simulated pine needles and said first ends of said fiber optic elements of said strip assembly being wound around said wire and projecting from said wire all therearound over a length of the wire to provide an interspersed array of said pine needles and said first ends of said fiber optic elements all along said length of the wire and therearound. The fiber optic elements are illuminated at said second ends to provide points of light at said first ends substantially all around the branch along its entire length.

In further accordance with the invention, the first ends of the fiber optic elements project from the band a greater distance than do the simulated pine needles.

According to a feature of the invention, the simulated pine needles are integrally fixed to a belt which is affixed to said band.

A feature of the invention is to employ an adhesive strip or ribbon to join the belt to the fiber optic elements.

In further accordance with the invention, the second ends of the fiber optic elements extend longitudinally along the trunk of the tree to a base end thereof whereat the fiber optic elements are illuminated.

According to another feature of the invention, a trunk strip is wound around the second ends of the fiber optic elements to secure the same in parallel relation along the length of the trunk.

According to a further feature of the invention, the trunk comprises a core element against which the fiber optic elements rest and are secured by the trunk strip.

According to a further feature of the invention, a means is provided between the illuminating means and the tips of the second ends of the fiber optic elements for producing varied illumination effects at the tips of the first ends of the fiber optic elements.

In further accordance with the invention, a method is provided for producing the illuminated artificial tree and the method comprises forming a plurality of branches for the artificial tree, each by the steps comprising:

a) placing a plurality of fiber optic elements in longitudinally juxtaposed relation;

b) affixing to said fiber optic elements adjacent to one of the ends thereof an assembly of simulated pine needles which extend along the transverse width of the fiber optic elements in adjacent relation to the ends of the fiber optic elements; and c) winding the simulated pine needles and the fiber optic elements spirally around a support wire so that the simulated pine needles and the ends of the fiber optic elements project from the wire all therearound along a length of the wire which is to represent the length of the branch.

The branches are assembled onto a trunk of the tree with the fiber optic elements of the respective branches extending longitudinally along the trunk to a location at the base of the trunk where the fiber optic elements can be illuminated and produce points of light at the free ends of the fiber optic elements all around all of the branches along the length of the branches.

In further accordance with the method of the invention, the simulated pine needles are integrally formed with a belt which is secured to the fiber optic elements to affix the simulated pine needles to the fiber optic elements, preferably by securing an adhesive ribbon to the belt and the fiber optic elements.

In further accordance with the method of the invention, the winding of the fiber optic elements and the simulated pine needles spirally around the support wire is effected by commencing winding of the fiber optic elements and the simulated pine needles at one end of the wire and progressively continuing the winding of the fiber optic elements and the simulated pine needles around the support wire along the length thereof.

According to a feature of the invention, the assembly of the branches onto the trunk begins at the top of the tree and progresses downwards. The fiber optic elements of the successive branches are secured to the trunk by winding a trunk strip around the fiber optic elements.

According to a further feature of the invention, at the end of at least one branch a cluster of fiber optic elements is formed to produce an illuminable ornamental article in addition to the points of light which surround the branch as provided by the spirally wound fiber optic elements.

DETAILED DESCRIPTION OF A PREFERRED EMBODIMENT

Figure 9:
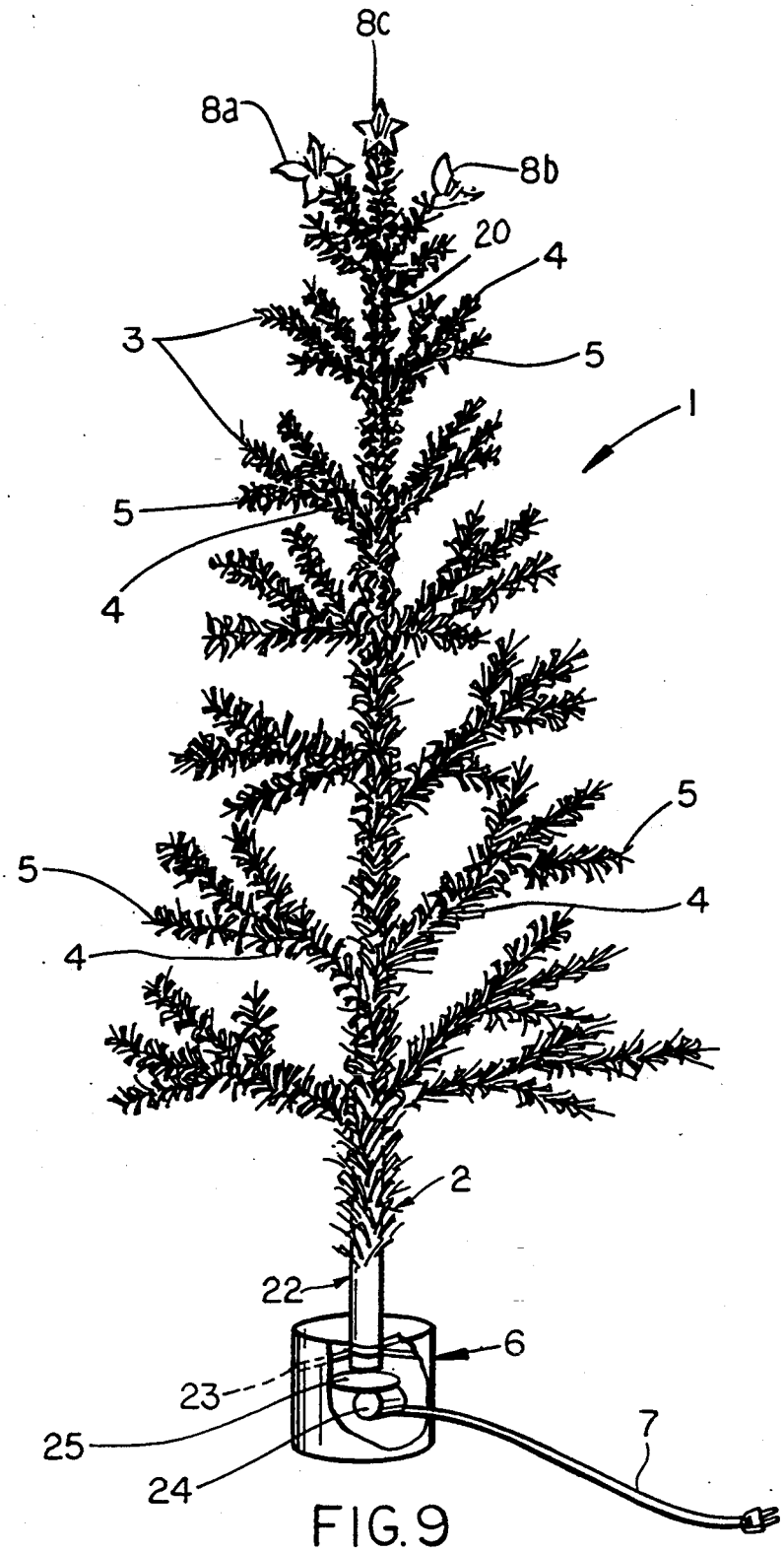
FIG. 9 shows the assembled tree utilizing the branches and ornamental articles.

Referring to FIG. 9 of the drawing, therein is shown an artificially illuminable tree 1 which is especially suitable as an artificially illuminable Christmas tree. The tree 1 comprises a trunk 2 having a plurality of branches 3 extending from the top of the trunk down to its base. The branches include main branches 4 which are directly joined to the trunk and sub-branches 5 which are joined to the main branches 4. Hereafter, when speaking of the manufacture of branches, this includes both main branches and sub-branches. The tree is mounted in a container 6 from which extends a power cord 7. At the top of the tree are ornamental decorative articles **8*a*, 8*b* and 8*c***.

The tree is characterized by providing points of light all around each of the branches along its entire length. Hence, a total illumination takes place around the entire tree in a substantially uniform monolithic fashion.

In order to achieve the above effect, the branches of the tree are formed in a specific manner to be described hereafter.

Figure 1:
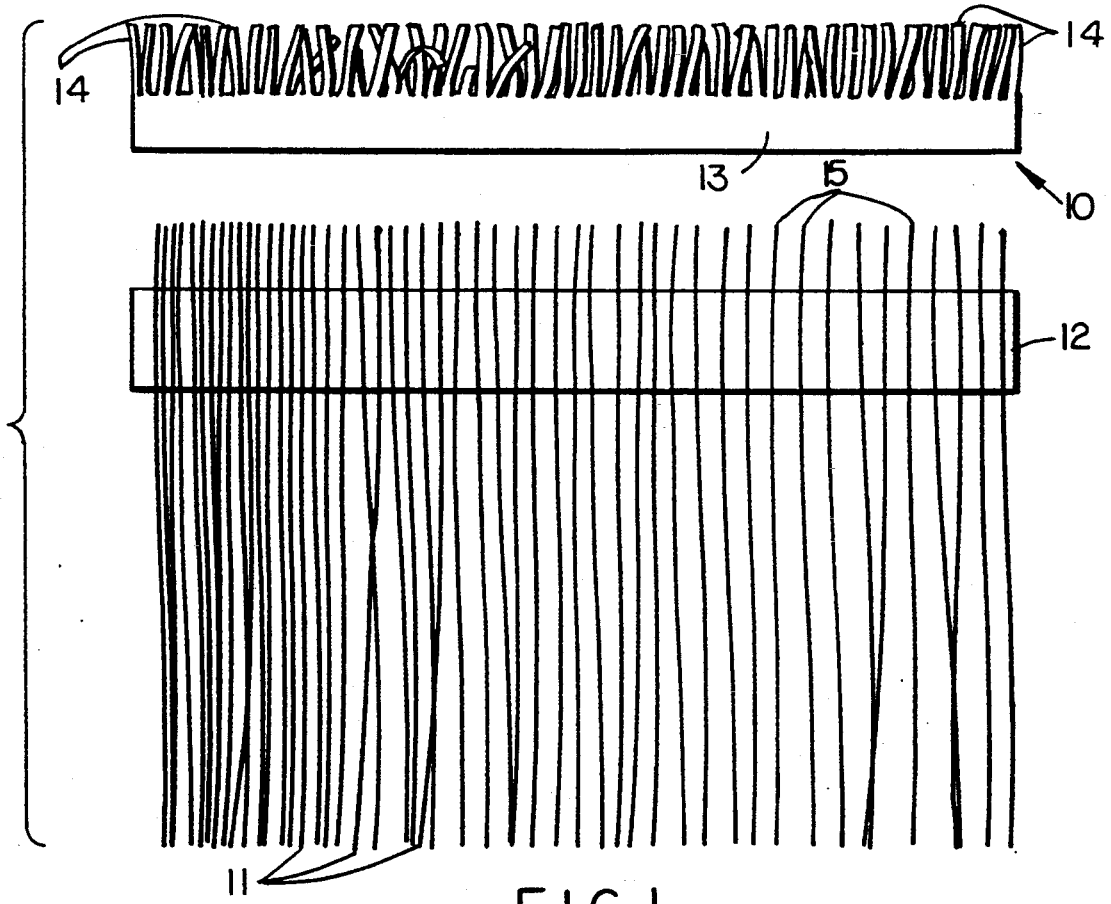
FIG. 1 diagrammatically illustrates the components in preparation for the formation of a branch of an artificially illuminated tree according to the invention.

FIG. 1 illustrates components which are to form a branch of the tree and include a simulated pine needle component 10 and a plurality of fiber optic elements 11. The fiber optic elements 11 are arrayed in juxtaposed substantially longitudinal relation and have substantial length for a purpose to be explained later. The fiber optic elements 11 are assembled in juxtaposed relation on an adhesive vinyl strip 12 which is located near the upper one of the ends of the fiber optic elements 11 in FIG. 1. In a typical construction, the vinyl band is transparent and is approximately $1\frac{1}{4}$ inches wide. The length of the band 12 and the number of fiber optic elements is a function of the length of the branch which in turn is a function of the position of the branch on the tree. In this regard, the shorter branches are generally higher up on the tree. The length of the fiber optic elements generally is greater for the shorter branches near the top of the tree as compared to the longer branches at the bottom of the tree as the fiber optic elements at the upper branches must be of sufficient length to reach the base of the tree and extend into the interior of the container 6. Conversely, the longer branches which are nearer the base of the tree require shorter lengths of the fiber optic elements to reach the bottom of the tree. While the fiber optic elements in FIG. 1 are generally disposed in juxtaposed relation, they are adhered to the strip 12 so that they are slightly fanned at the bottom in FIG. 1 and in general for three to four inches of length of the fiber optic elements, the spacing between the elements increases from 1/16 of an inch to $\frac{1}{4}$ of an inch. This will facilitate interspersal of the greater number of fiber optic elements as they approach the bottom of the tree as will become evident later.

Figure 2:
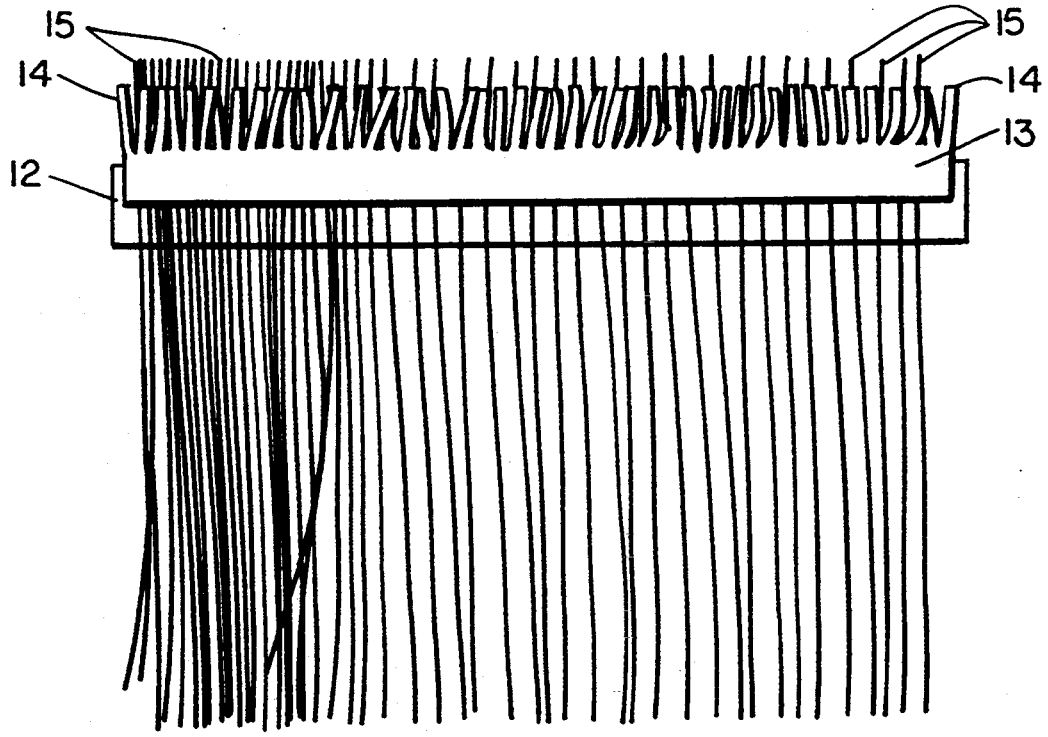
FIG. 2 shows a first step in the assembly of the components in FIG. 1.
Figure 3:
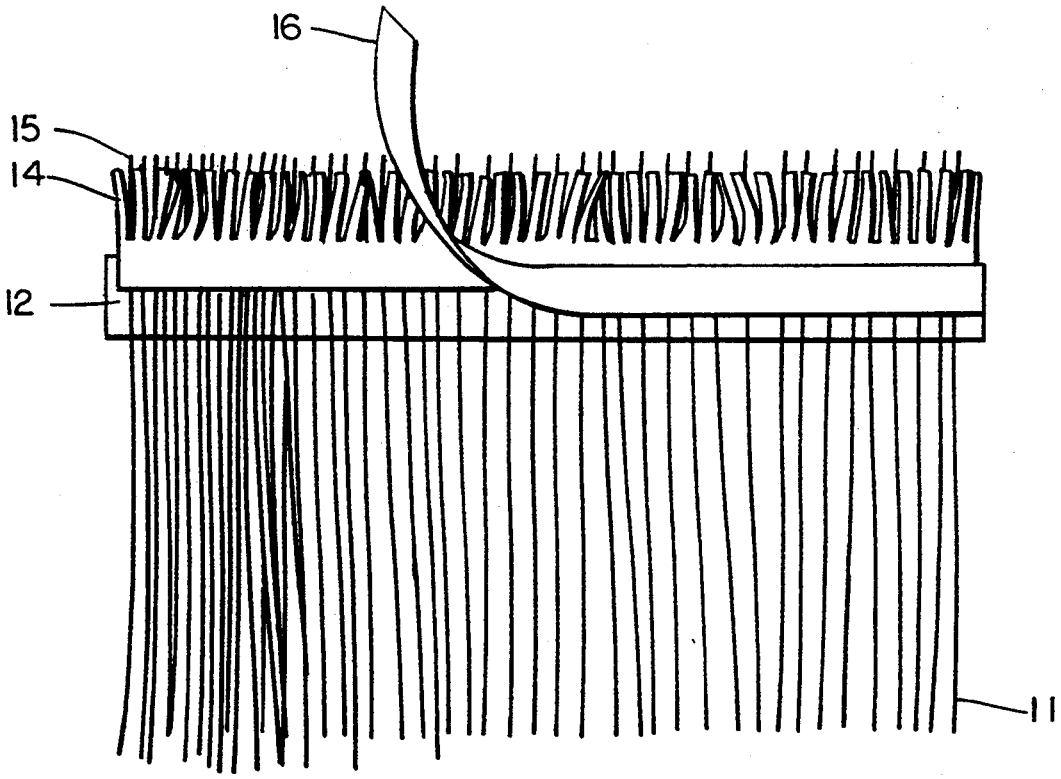
FIG. 3 shows a further assembly step of the components.

After the fiber optic elements have been assembled to the adhesive strip 12, the simulated pine needle component 10 is joined thereto. Specifically as shown in FIG. 2, the component 10 is placed on the juxtaposed fiber optic elements in a position to be affixed thereto. The component 10 consists of a solid belt or base 13 from which extend filaments 14 simulating pine needles. When the belt 13 is placed on the fiber optic elements 11 the filaments or pine needles 14 are juxtaposed with the free ends 15 of the fiber optic elements 11. The tips of the fiber optic elements are shown in FIG. 2 to project slightly beyond the ends of the filaments 14 and will be prominent when illuminated. However, the tips of the fiber optic elements 11 can be trimmed to be even with the ends of the filaments 14. A second adhesive strip 16 is then placed over the belt 13 of pine needle component 10 and the fiber optic elements 11 to fix the needle component 10 to the fiber optic elements 11.

The adhesive strips 12 and 16 can be clear or they can be colored to approximate the color of the foliage simulated by component 10. It is to be noted that the strip 16 is narrower than the strip 12 so that when the strip 16 is applied in place, the strip 12 will extend below the bottom edge of strip 16 and leave an adhesive surface exposed between the fiber optic elements 11.

Figure 4:
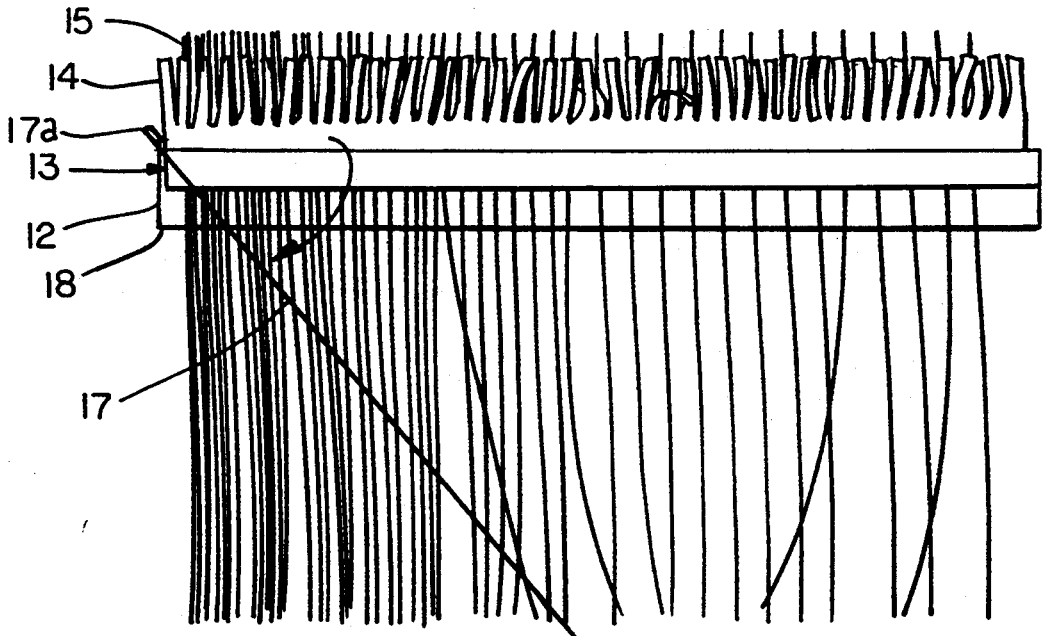
FIG. 4 shows the first stage for the winding of the assembled components to form the branch.
Figure 5A:
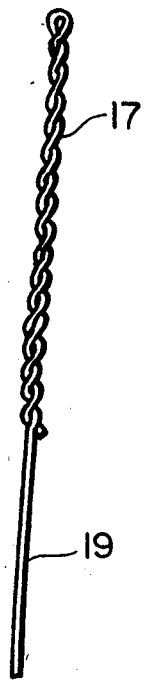
FIG. 5A is a detail showing the configuration of a wire element in the intermediate stage shown in FIG. 5.

The thus constituted assembly of the fiber optic elements and the pine needle component is ready for the formation of a branch as illustrated in FIG. 4. Therein is seen a wire 17 of moderately flexible property sufficient to support the weight of the components of the branch (including any sub-branches) as part of the formation of the tree illustrated in FIG. 9. The wire 17 can be straight and untwisted or if greater rigidity is required the wire 17 can be twisted as shown in FIG. 5A. The wire 17 is placed at an angle of approximately 45° with respect to the longitudinal array of the fiber optic elements and an end 17*a* of the wire 17 is disposed in proximity to the lower edge of the filaments of the pine needle component 10 so as to leave a lower front corner 18 of exposed adhesive strip 12 on the left side of wire 17 as shown in FIG. 4. The lower front corner 18 of the exposed adhesive strip 12 is then folded up and over the end 17*a* of the wire to secure the assembly of the fiber optic elements 11 and pine needle component 10 to the wire 17. The assembly is then helically wound in the opposite direction progressively around the wire 17 in the manner illustrated by the arrow in FIG. 4.

Figure 5:
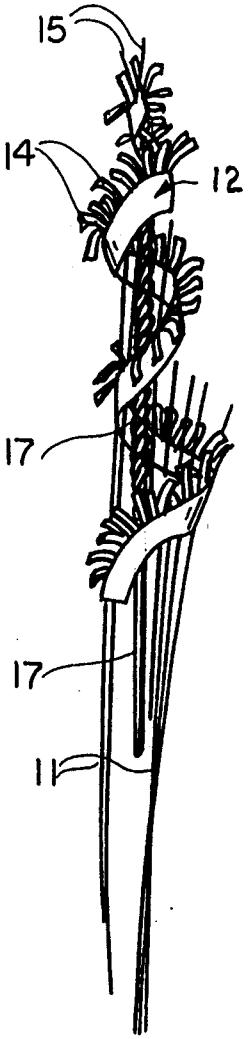
FIG. 5 shows an intermediate stage in the formation of the branch.
Figure 6:
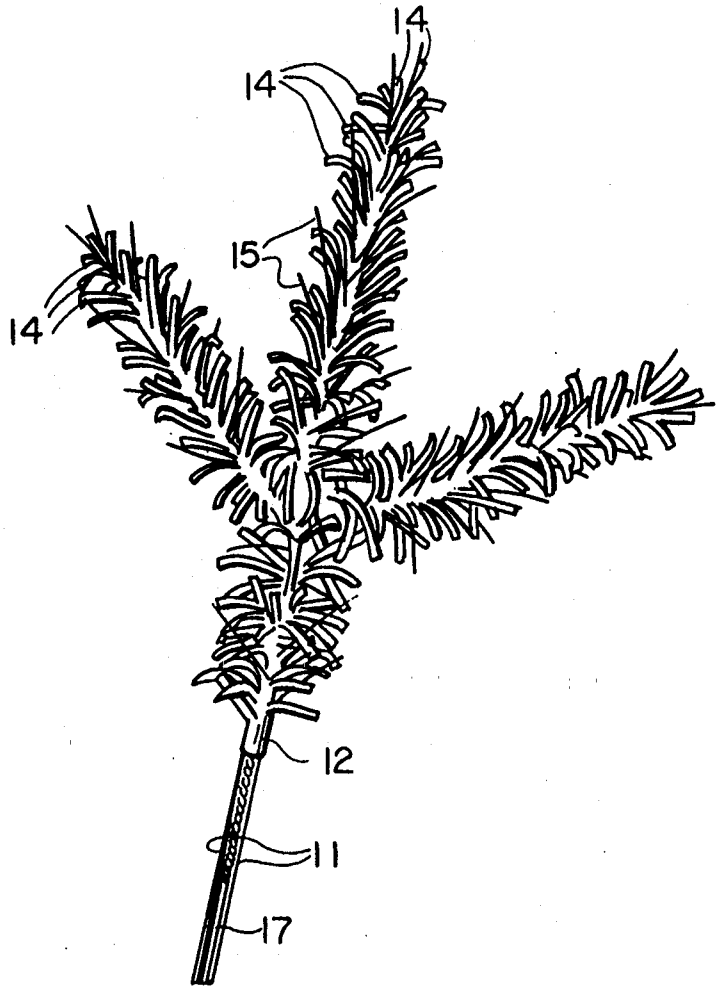
FIG. 6 shows an assembly of a plurality of branches.

FIG. 5 shows the winding process in an intermediate stage. The wire 17 is of sufficient length so that upon completion of helical winding of the assembled fiber optic elements and pine needle component around the wire, there will be an extension 19 of the wire beyond the formed branch. The extension 19 will be utilized to attach the branch to the trunk of the tree (when the branch is a main branch) or to another branch (when the branch is a sub-branch). If ornaments 8*a*, 8*b* or 8*c* are to be placed at the ends of a branch, these ornaments, which include fiber optic elements, are preformed and placed at the end of the wire 17 with the fiber optic elements of the ornament extending from the ornamental element along the wire 17 so that when the assembly is helically wound around the wire 17, the fiber optic elements of the ornaments 8*a*, 8*b* or 8*c* will extend from the tip of the branch to beyond the base of the branch. The ornament 8*a* is in the form of a flower, the ornament 8*b* a ball and the ornament 8*c* a star. The fiber optic elements of each ornament are grouped as a bundle or cluster and extend as a spray from the base of the respective ornament.

It is pleasing if the tree is formed as shown in FIG. 9 in which at least one sub-branch 5 is attached to a main branch 4 starting with the branches at the second level down from the top of the tree.

In order to form the trunk of the tree, a core 20 of metal rod is used, preferably a non-corrosive metal that will support the weight of all of the branches of the tree.

When the full complement of branches and sub-branches have been produced, the tree is then assembled from the top using a branch assembled from artificial foliage and fiber optic elements in the same way as the strips used for forming the branches. An adhesive strip 21, called a trunk strip is wound around the fiber optic elements to hold them against a rod or core 20. Several trunk strips 21 can be wound consecutively in the process and the most important aspect is the length of the fiber optic elements relative to their position of wrapping on the core to form the trunk. That is, the fiber optic elements must be of such a length as to extend to the container 6 and be exposed thereat to a light source 24 disposed therein. Therefore, as the wrapping proceeds along the trunk, the length of the fiber optic elements in the lower branches may be reduced in the assembling process. However, the length of the fiber optic elements must reach from the tip of each branch to the light source 24.

Starting at the top of the tree, the initial branch, illustrated with the ornamental star element 8*c* in FIG. 9, is at the top of the rod 20. The trunk strip 21 is wrapped in a downward helical winding direction around the projecting end 19 of the "star branch" and the rod or core 20. After approximately three inches of the trunk has been wrapped from the top, three of the shortest branches are incorporated around the trunk using the trunk strip 21 to hold the branches in place with the optical fibers from these branches worked around and down to the base of the tree. The wrapping is continued for another 3 inches down the trunk and four branches, also of the shortest length are now incorporated in the same manner as the previous three branches. This process is continued at levels which increase to 4 inches, 5 inches and 6 inches between the horizontal branch levels progressively down the trunk of the tree. The branches are incorporated in the same way at each level and are increased in number and length thereof as the assembly of the tree continues down the trunk. The trunk strip 21 which is used to attach the optical fibers in the branches and sub-branches onto the trunk have a greater concentration of optical fibers as the trunk extends downwardly towards the base as compared to the number of fiber optic elements near the top of the tree. Hence, the fiber optic elements are spaced at wider intervals as the wrapping proceeds down the trunk. Accordingly, the tree is assembled in horizontal levels in a vertical assembly fashion beginning at the top and extending down to the base where the trunk is placed into container 6. The shortest branches are at the top and the longest branches are at the base. The length of the branches progressively increases working from the top to the base. The branches at each level will be assembled and integrated with the trunk as described above with the free lengths of the optical fiber ends from each branch extending along the trunk and terminating at the base of the trunk in a fitting 22 which will permit the fiber optic elements to be trimmed to form a flat uniform end surface. The fitting 22 into which all of the fiber optic elements are ultimately placed is then mounted into a holder 23 in container 6 such that the lower ends of the fiber optic elements are all in facing relation adjacent to light source 24. The light source 24 is connected by power line 7 to an electrical source. The electrical source can be an electric power outlet carrying house current or batteries contained within the container 6.

When the light source is energized, all of the fiber optic elements throughout the tree will be illuminated creating a uniform arrangement of points of light of the tips of the fiber optic elements around all of the branches and along their entire lengths. By way of example, for a tree 3 feet high 15,000 fiber optic elements can be employed and illuminate by a small flashlight bulb to produce the uniform illumination of the tree.

In a modified arrangement, the core 20 is formed as a hollow tube through which the fiber optic elements of the ornaments 8*a*, 8*b* or 8*c* can pass to the fitting 22 at the lower end of the trunk. This allows the ornaments to be securely placed. The fiber optic elements of the branch can be integrated with those of the ornament and also be placed within the hollow tube.

Figure 8C:
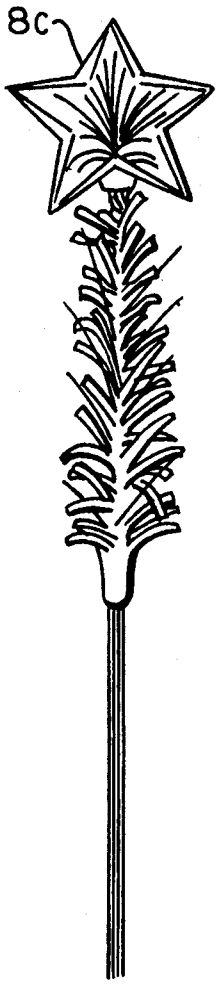
FIG. 8C shows the branch with a third embodiment of ornamental article.
Figure 8B:
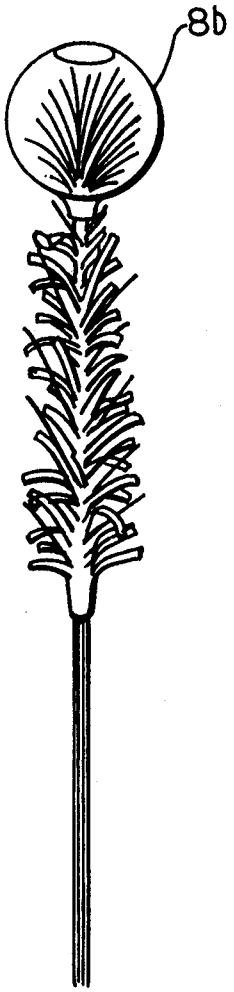
FIG. 8B shows the branch with a second embodiment of ornamental article.
Figure 8A:
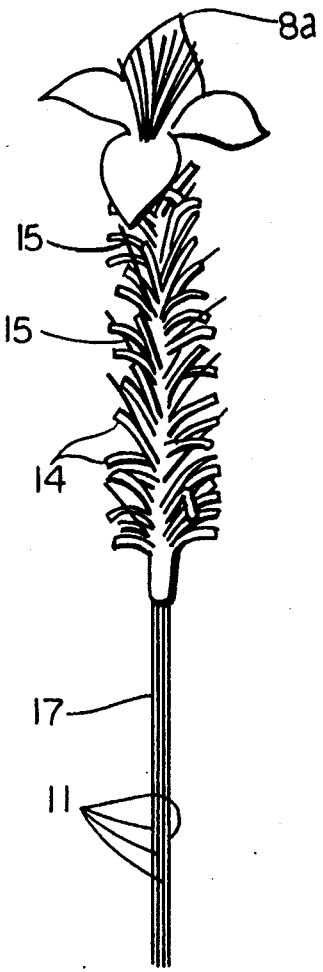
FIG. 8A shows a branch having a first embodiment of an ornamental article at the end of the branch.
Figure 7:
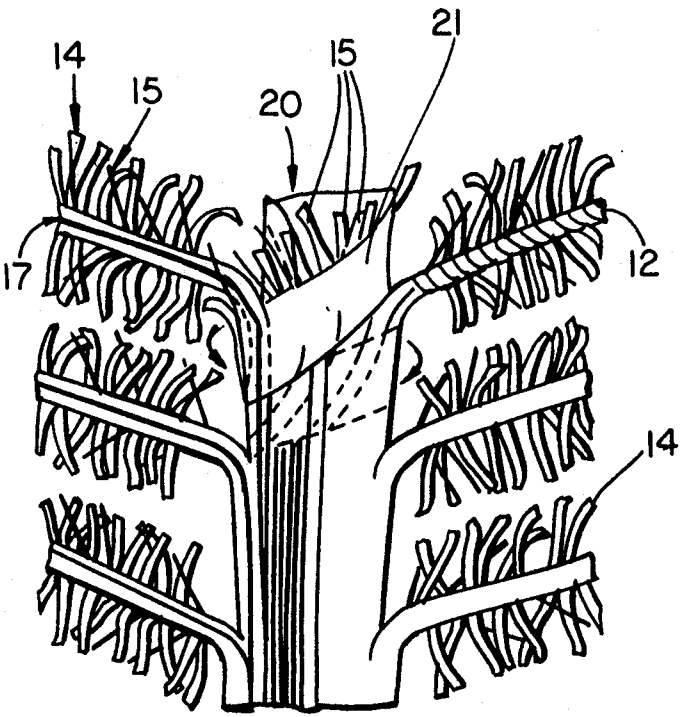
FIG. 7 shows a detail of a portion of the trunk of the tree to illustrate the attachment of the branches to the trunk.
Figure 9A:
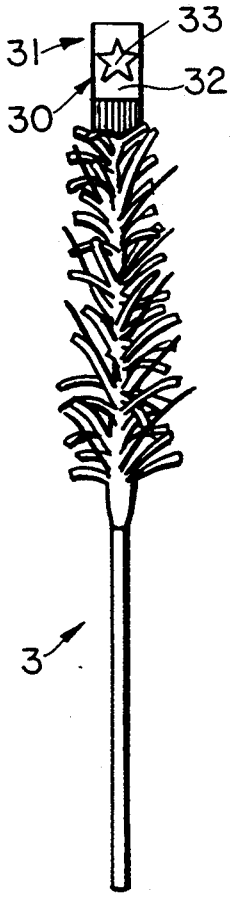
FIG. 9A shows a branch having a modified ornamental article thereon.
Figure 9B:
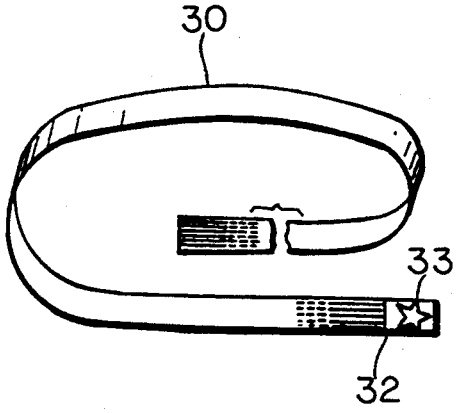
FIG. 9B shows a ribbon which forms the ornamental article of FIG. 9A.

In another modified arrangement, instead of forming the ornaments with a bundle of individual fiber optic elements as in FIGS. 8A, 8B and 8C, the ornaments can be formed from a ribbon 30 (FIG. 9B) of joined fiber optic elements. Such an ornament is shown in FIG. 9A at 31. The ribbon 30 is itself known in the art and is conventionally formed by joining a plurality of fiber optic elements together by applying a bonding agent to one side of the fiber optic elements. It is also known to hot stamp the sheaths of the fiber optic elements of the ribbon to produce a light emission region 32. In an alternate procedure to produce the light emission region, the surface of the ribbon is abraded where light emission is to be provided. The light emission 32 can be formed with a design 33 which is illustrated in FIGS. 9A and 9Bas a star; however, other designs can be produced such as a crescent or suitable geometric pattern to provide special illumination effects. The ribbon 30 with light emission region 32 can be included in the tree at the ends of branches, in the middle of branches, or along the trunk. The ribbon is of the order of one inch or less in width and the fiber optic elements of the ribbon below the light emission region 32 are installed in the same manner as for the fiber optic elements of the ornaments 8*a*, 8*b* and 8*c*. In this regard, in the formation of a branch as shown in FIG. 4, the ribbon 30 is placed along the wire 17 with the light emission region 32 thereof disposed outwardly of the wire 17, and the assembly of the elements of the branch are wound helically around the wire as before, thereby producing the branch 3 as shown in FIG. 9A.

In a variation to obtain varying lighting effects, a patterned or colored plate 25 can be interposed between the light source 24 and the lower ends of the fiber optic elements and the plate 25 can be driven in rotation. This will produce varying lighting effects at the tips of the fiber optic elements around the branches and in the ornaments.

Although the invention has been described in relation to specific embodiments thereof, it will become apparent to those skilled in the art that numerous modifications and variations can be made within the scope and spirit of the invention as defined in the attached claims.

What is claimed is:

1. An illuminated artificial tree comprising a trunk and a plurality of branches extending from said trunk, each branch including an elongated support wire and a strip assembly spirally wound around said wire along a length thereof, said strip assembly comprising a band and a plurality of juxtaposed fiber optic elements and simulated pine needles secured to said band substantially along the length thereof, said fiber optic elements having first ends extending from said band in adjacent relation with said simulated pine needles and second ends extending from said band in a direction opposite the first ends and the simulated pine needles, said simulated pine needles and said first ends of said fiber optic elements of said strip assembly being wound around said wire and projecting from said wire therearound over said the length of the wire to provide an interspersed array of pine needles and said first ends of said fiber optic elements all along said length of the wire and therearound, and means for illuminating the fiber optic elements at said second ends to provide points of light at said first ends substantially all around the branch along its length.

2. An illuminated tree as claimed in claim 1, wherein said first ends of the fiber optic elements project slightly beyond the simulated pine needles.

3. An illuminated tree as claimed in claim 1, comprising a belt to which said simulated pine needles are integrally joined.

4. An illuminated tree as claimed in claim 3, said strip assembly comprising an adhesive strip joining said belt to said fiber optic elements.

5. An illuminated tree as claimed in claim 1, wherein said second ends of said fiber optic elements extend longitudinally along said trunk to a base end thereof, said means which illuminates said fiber optic elements being disposed at said base end.

6. An illuminated tree as claimed in claim 5, comprising a trunk strip wound around the fiber optic elements to secure the same in longitudinal relation along the length of the trunk.

7. An illuminated tree as claimed in claim 6, comprising means between the illuminating means and tips of the second ends of the fiber optic elements for producing varied illumination effects at tips of the first ends of the fiber optic elements.

8. An illuminated tree as claimed in claim 7, comprising an ornamental article on said branch at a location remote from the trunk.

9. An illuminated tree as claimed in claim 8, wherein said ornamental article includes a plurality of further fiber optic elements extending longitudinally along at least one branch and formed as a cluster projecting from a free end of the branch.

10. An illuminated tree as claimed in claim 9, wherein said ornamental article comprises a ribbon of joined fiber optic elements and a light emission region in said ribbon.

* * * * *